United States Patent [19]

Natwick

[11] Patent Number: 5,050,705

[45] Date of Patent: Sep. 24, 1991

[54] ROOF CREEPER KIT APPARATUS

[76] Inventor: Peter J. Natwick, 9024 6th Ave. NW., Seattle, Wash. 98117

[21] Appl. No.: 564,119

[22] Filed: Aug. 8, 1990

[51] Int. Cl.[5] ..... E04G 3/00

[52] U.S. Cl. ..... 182/45; 248/237

[58] Field of Search ..... 182/45, 121, 122, 109, 182/107, 214, 129; 248/237

[56] References Cited

U.S. PATENT DOCUMENTS

| | | | |
|---|---|---|---|
| 354,703 | 12/1886 | Huestis | 182/45 |
| 524,661 | 8/1894 | Austin | 182/45 X |
| 955,159 | 4/1910 | Hillmon | 182/45 |
| 1,028,362 | 6/1912 | King | 182/45 |
| 1,143,555 | 6/1915 | Schimmelpfennig | 182/45 |
| 1,471,947 | 10/1923 | Cornelius | 182/45 |
| 1,743,371 | 1/1930 | Montag | 182/45 |
| 2,285,663 | 6/1942 | Ingram | 182/45 |
| 4,852,692 | 8/1989 | Flaherty | 248/237 |

*Primary Examiner*—Karen J. Chotkowski
*Attorney, Agent, or Firm*—Leon Gilden

[57] ABSTRACT

An apparatus for positioning an individual in a secure relationship relative to a shingle or shake roof construction includes a platform with spaced rails underlying the platform, the platform angulating adjustable relative to the rails. Each rail includes a forward and rear hook plate, with the forward hook plate including a bifurcated hook member, and the rear hook plate including a bifurcated rear hook member and a single hook forward portion. An anchor member is provided including a plurality of legs secured radially to and in equally spaced relationship to a central support, with each of the legs including a spring mount to permit deflection of the legs in securement to a shingle-type structure, with a second leg bisecting a plurality of adjacent legs rigidly mounted to the central plate. Further, ladder leg support structure is provided including a "U" shaped claw member, with a single forward claw and bifurcated rear claw organization and spaced parallel flanges to pivotally receive a ladder leg therebetween for mounting upon the aforenoted roof structure.

10 Claims, 4 Drawing Sheets

Fig 9
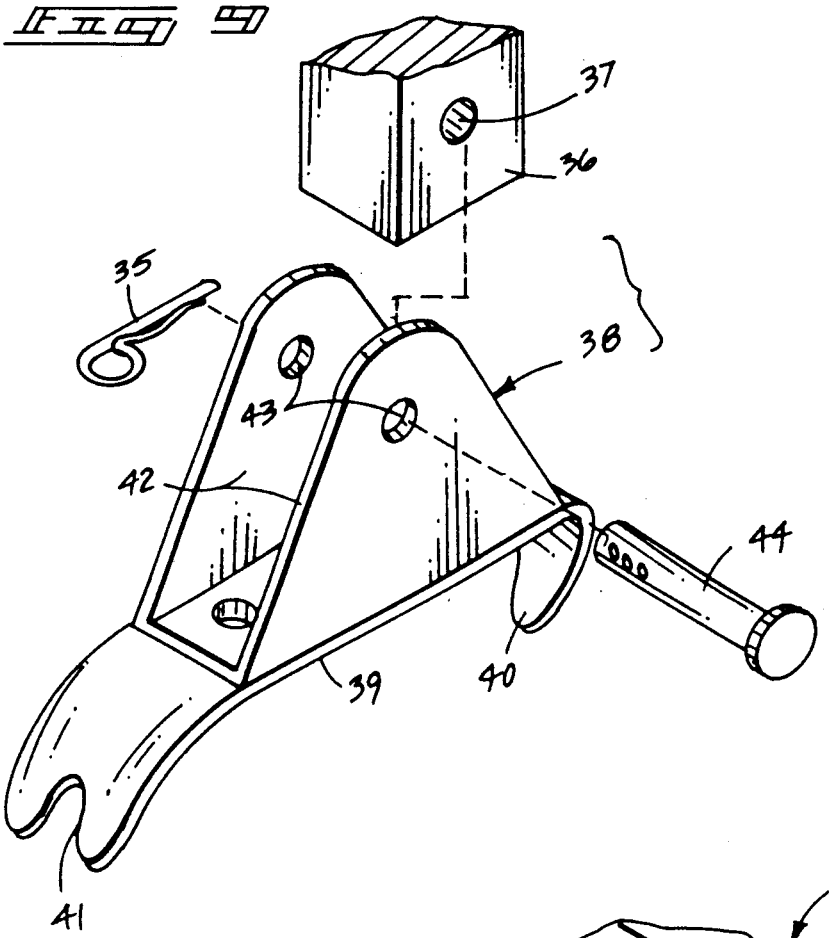
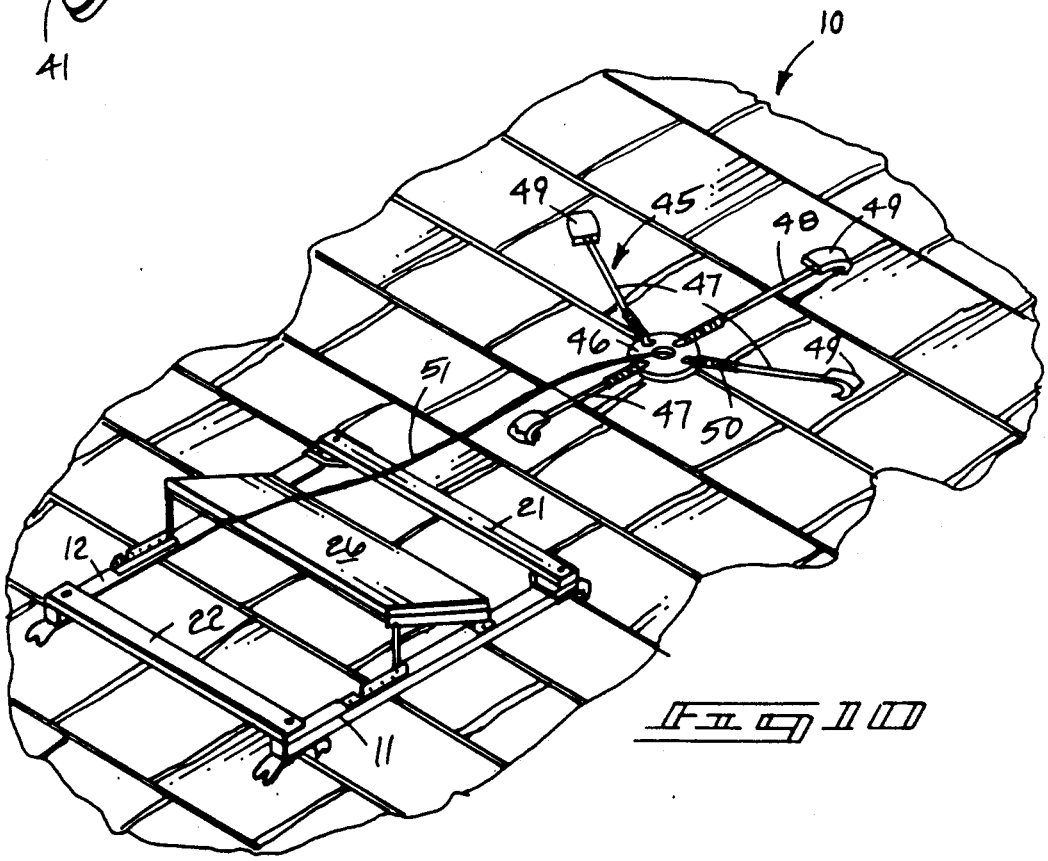
Fig 10

ROOF CREEPER KIT APPARATUS

BACKGROUND OF THE INVENTION

1. Field of the Invention

The field of invention relates to roof positioning organizations, and more particularly pertains to a new and improved roof creeper kit apparatus wherein the same provides an assemblage for permitting securement and positioning of an individual relative to a roof structure, particularly a roof structure of angulated configuration and utilizing shingle construction.

2. Description of the Prior Art

Various roof mounting apparatus has been provided in the prior art to position and secure an individual relative to an associated roof structure. Examples of such prior art structure may be found in U.S. Pat. No. 1,743,371 to Montag wherein a roof support construction utilizes a forward and rear sharpened hook member mounted upon each brace of a plurality of spaced parallel braces to secure a platform therebetween.

U.S. Pat. No. 4,632,219 to Rayer sets forth a roof ladder construction wherein hook portions are formed at each end of braces coextensively mounting the ladder overlying each of the braces.

U.S. Pat. No. 2,320,538 to Vogt sets forth a roof shingle seat structure utilizing bracketry with projecting members to pierce and secure the bracketry relative to a roof structure.

U.S. Pat. No. 4,856,745 to Mabie sets forth a roof scaffold support wherein the bracket structure is nailed to an underlying roof for positioning the bracketry thereto.

As such, it may be appreciated that there continues to be a need for a new and improved roof creeper kit apparatus which addresses both the problems of ease of use as well as effectiveness in construction in positioning and orienting an individual relative to a sloping roof structure utilizing hook portions with beveled interior surfaces to assist in engaging a roof structure upon deflection of support rails utilized by the instant invention.

SUMMARY OF THE INVENTION

In view of the foregoing disadvantages inherent in the known types of positioning apparatus now present in the prior art, the present invention provides a roof creeper kit apparatus wherein the same provides supporting hook structure, wherein the hook structure includes interior beveled surfaces cooperative with a deflecting framework to enhance engagement into an underlying roof surface without undue damage thereto. As such, the general purpose of the present invention, which will be described subsequently in greater detail, is to provide a new and improved roof creeper kit apparatus which has all the advantages of the prior art roof positioning organizations and none of the disadvantages.

To attain this, the present invention provides an apparatus for positioning an individual in a secure relationship relative to a shingle or shake roof construction including a platform with spaced rails underlying the platform, the platform angulating adjustably relative to the rails. Each rail includes a forward and rear hook plate, with the forward hook plate including a bifurcated hook member, and the rear hook plate including a bifurcated rear hook member and a single hook forward portion. An anchor member is provided including a plurality of legs secured radially to and in equally spaced relationship to a central support, with each of the legs including a spring mount to permit deflection of the legs in securement to a shingle-type structure, with a second leg bisecting a plurality of adjacent legs rigidly mounted to the central plate. Further, ladder leg support structure is provided, including a "U" shaped claw member, with a single forward claw and bifurcated rear claw organization and spaced parallel flanges to pivotally receive a ladder leg therebetween for mounting upon the aforenoted roof structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roof creeper kit apparatus which has all the advantages of the prior art roof positioning organizations and none of the disadvantages.

It is another object of the present invention to provide a new and improved roof creeper kit apparatus which may be easily and efficiently manufactured and marketed.

It is a further object of the present invention to provide a new and improved roof creeper kit apparatus which is of a durable and reliable construction.

An even further object of the present invention is to provide a new and improved roof creeper kit apparatus which is susceptible of a low cost of manufacture with regard to both materials and labor, and which accordingly is then susceptible of low prices of sale to the consuming public, thereby making such roof creeper kit apparatus economically available to the buying public.

Still yet another object of the present invention is to provide a new and improved roof creeper kit apparatus which provides in the apparatuses and methods of the prior art some of the advantages thereof, while simultaneously overcoming some of the disadvantages normally associated therewith.

Still another object of the present invention is to provide a new and improved roof creeper kit apparatus wherein the same permits secure anchoring of an individual relative to a roof structure while simultaneously preventing undue damage to the underlying roof structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric illustration, somewhat exploded, of a ladder support bracket structure utilized by that instant invention.

FIG. 10 is an isometric illustration of the instant invention utilizing an anchor member in securing the association to a roof structure.

DESCRIPTION OF THE PREFERRED EMBODIMENT

Figure 1:
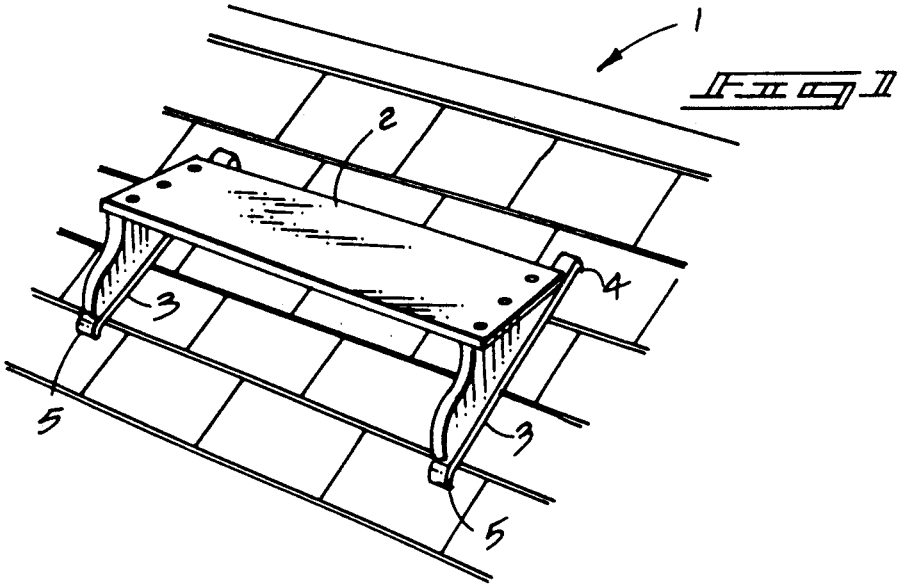
FIG 1 PRIOR ART
FIG. 1 is an isometric illustration of a prior art roof positioning apparatus.

With reference now to the drawings, and in particular to FIGS. 1 to 10 thereof, a new and improved roof creeper kit apparatus embodying the principles and concepts of the present invention and generally designated by the reference numeral 10 will be described.

Figure 2:
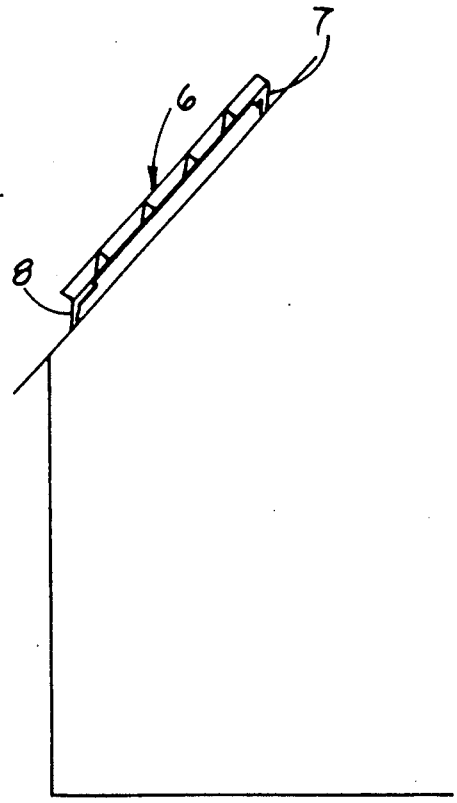
FIG 2 PRIOR ART
FIG. 2 is an orthographic side view, taken in elevation, of a further prior art roof positioning apparatus.

FIG. 1 illustrates a prior art roof mounting structure as set forth in U.S. Pat. No. 1,743,371, wherein a platform 2 is mounted laterally thereof to a plurality of spaced parallel support brackets 3 that include a forward and rear respective projection 4 and 5 to secure the structure to an associated roof. FIG. 2 illustrates a further prior art roof mounting apparatus, wherein a ladder structure 6 includes a forward hook portion 7 and a rear bifurcated hook portion 8, as set forth in U.S. Pat. No. 4,632,219, to mount the structure to an associated roof.

Figure 3:
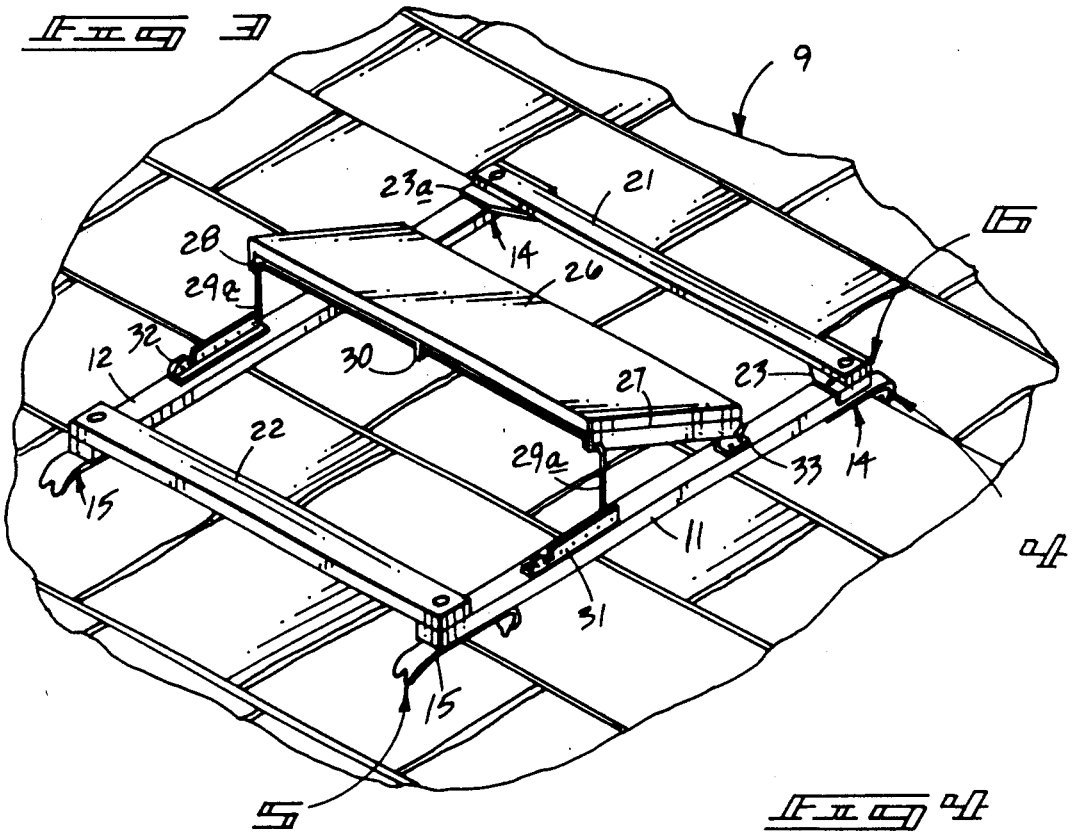
FIG. 3 is an isometric illustration of a roof support organization utilized by the instant invention.
Figure 4:
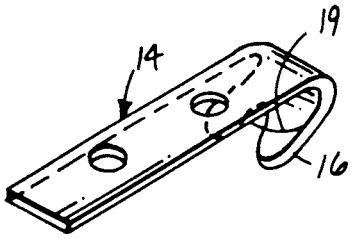
FIG. 4 is an isometric illustration of the forward hook plate utilized by the instant invention.

More specifically, the roof creeper kit apparatus 10 of the instant invention essentially includes a support member, as illustrated in FIG. 3, with a first and second deflecting frame rail 11 and 12 arranged parallel in a spaced relationship coextensively positioned relative to one another. The frame rails are of an elongate, longitudinally aligned construction and are arranged to deflect upon application of force to the support member. A forward hook plate 14, of a generally "J" shaped configuration, is mounted to each forward terminal end of each frame rail and extends forwardly thereof in a longitudinally aligned relationship. A rear hook plate 15, of a generally "U" shaped configuration, is mounted to the bottom surface and rear terminal end of each frame rail, wherein each forward hook plate 14 includes a forward single hook 16 underlying the body of the hook plate defining an acute angle therebetween of substantially sixty degrees. The rear hook plate 15 includes a rear bifurcated hook 17 defining an obtuse angle between a bottom surface of the plate body of the rear hook plate 15 of an angle generally one hundred thirty-five degrees therebetween. A rear single hook 18 formed at a forward end of the hook plate 15 underlies the hook plate body and defines an acute angle of generally fifty degrees. It is also presented that the interior surfaces of each of the hooks 16, 17, and 18 are beveled, whereupon flexure of an associated frame rail 11 or 12 effects enhanced anchoring and positioning of each of the hooks within the roof surface 9.

Figure 6:
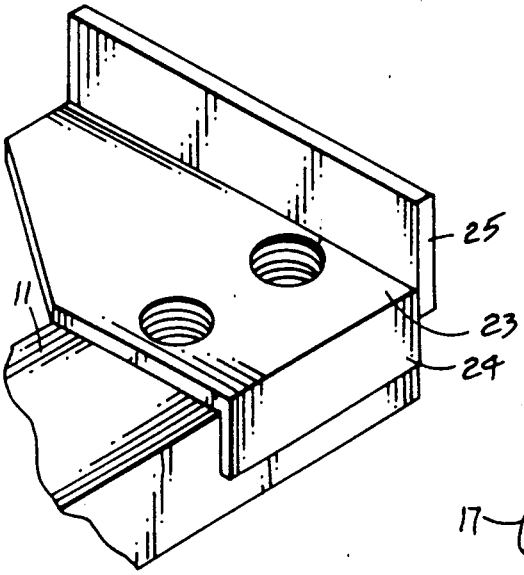
FIG. 6 is an isometric illustration of the forward support bracket utilized by the instant invention.
Figure 5:
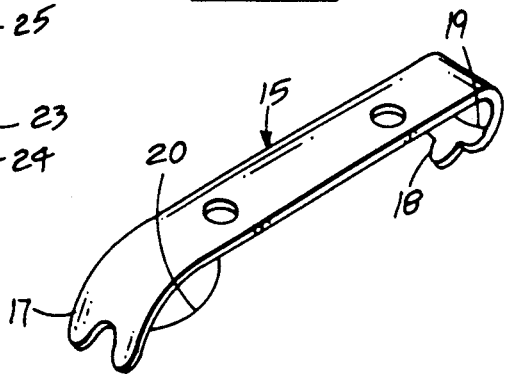
FIG. 5 is an isometric illustration of the rear hook plate utilized by the instant invention.
Figure 7:
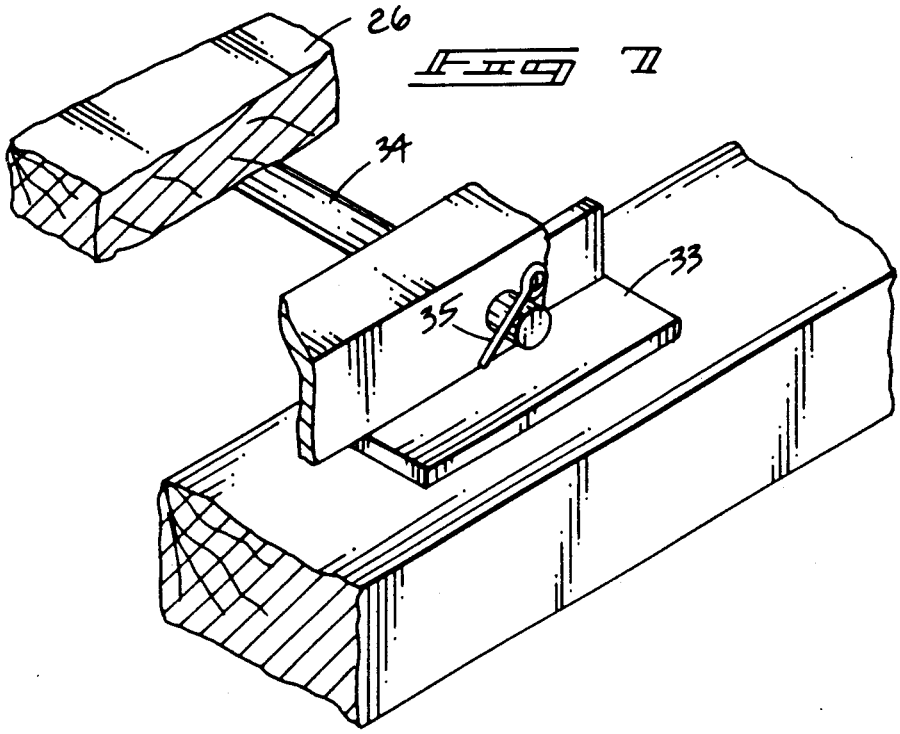
FIG. 7 is an isometric illustration of the forward right support bracket utilized in mounting the support platform of the instant invention.
Figure 8:
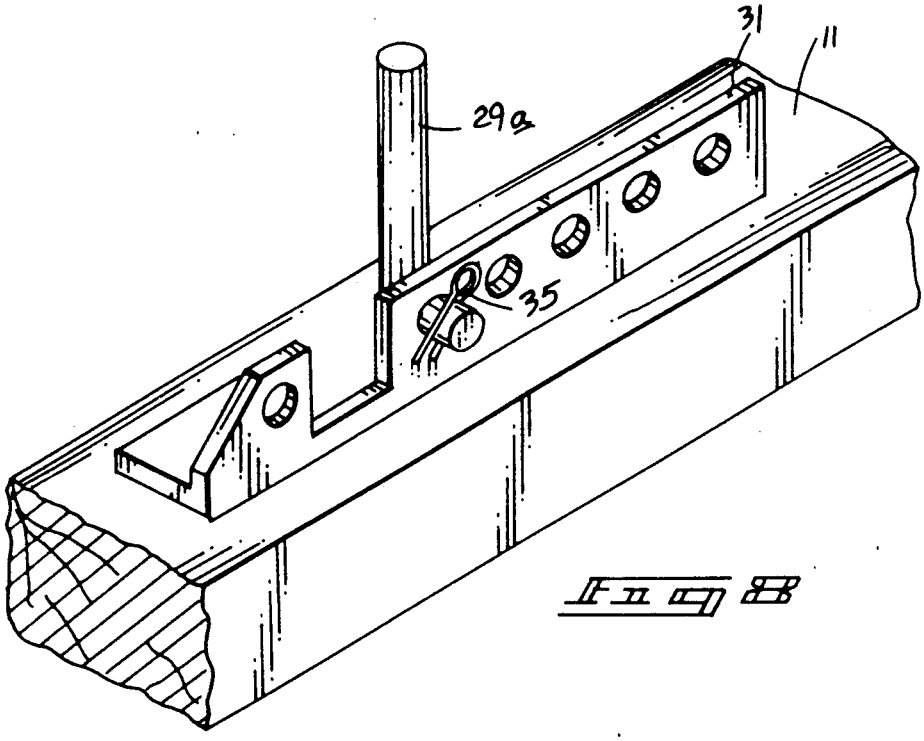
FIG. 8 is an isometric illustration of a right apertured adjusting bracket utilized by the instant invention and mounting the support platform.

A forward frame brace 21 orthogonally and integrally mounts to the top surface of each forward terminal end of the first and second frame rails 11 and 12, and wherein a rear forward frame brace 22 is mounted to the top rear surface adjacent a rear terminal end of each frame rail 11 and 12 to define a rectangular framework. The forward frame brace 21 is mounted at each end to a respective first and second elongate support bracket 23 and **23*a* arranged orthogonally relative to an associated and respective frame rail 11 and 12, with the first and second brackets 23 and 23*a* of a mirror image construction relative to one another. Reference to FIG. 6 illustrates that the brackets include a first flange 24 overlying an exterior side wall of an associated frame rail, with a second flange 25 arranged longitudinally of and coextensively with each support bracket to fixedly secure and arranged the forward frame brace 21 in an orthogonal relationship relative to the side rails 11 and 12 to avoid deformation of the rectangular framework of the support member. A support platform 26 is orthogonally and adjustably mounted overlying the first and second frame rails 11 and 12, with a right and left apertured adjusting bracket 31 and 32 formed with apertures therealong to receive a downwardly depending "L" shaped leg 29*a* of a "U" shaped adjusting rod 29 and is mounted coextensively with a rear end edge of the platform 26 and pivotally received through right, left and center brackets 27, 28 and 30. Reference to FIG. 8 illustrates that each lower terminal end of the "L" shaped legs 29*a* is receivable through an associated aperture of one of the right or left apertured brackets 31 or 32, and is secured within the associated bracket by a locking clip 35. The forward edge of the support platform 26 includes an elongate forward support rod 34 that is pivotally mounted at each end thereof to a forward support bracket 33 of a generally "L" shaped configuration that includes a locking clip 35 at each terminal end of the support rod 34 to prevent inadvertent removal of the support rod 34 from its associated support bracket. In this manner, the platform 26** may be angularly tilted and adjusted as required relative to the rectangular framework.

Reference to FIG. 9 illustrates the use of a plurality of ladder support brackets 38 that are pivotally mounted to a lower terminal end of each ladder leg 36 of a conventional ladder. Each ladder leg 36 includes a ladder leg aperture 37 directed therethrough, with the support bracket 38 including a "U" shaped claw member 39, with a single forward claw 40 and a bifurcated rear claw 41, with the forward claw 40 defining an acute angle between the claw and the body of the claw member of generally sixty degrees, with the bifurcated rear claw defining an obtuse angle, with an included angle of one hundred thirty-five degrees. Parallel spaced flanges 42 are integrally mounted to each side edge and extend upwardly from the body of the "U" shaped claw member 39, with each flange including an aperture 43, wherein the apertures 43 are coaxially aligned to receive a support pin 44 directed through the apertures and the ladder leg aperture 37 to pivotally mount the ladder leg aperture thereon, with a locking clip 35 directed through the support pin 44 exteriorly of a flange 42, whereupon in this manner the "U" shaped claw members effectively anchor and secure a ladder to the roof surface 9 during use. Further, it is understood that the interior surfaces of the forward and rear claws 40 and 41 are also beveled to enhance engagement with a roof surface 9 during use.

FIG. 10 illustrates the organization in use with an anchor member 45. The anchor member 45 includes a central cylindrical plate 46, with three first support legs 47 diametrically mounted to a perimeter of the central plate 46 an equal distance relative to one another defining generally one hundred twenty degrees spacing, with each first support leg including a spring mount 50 mounting each support leg 47 to the central plate 46, wherein the spring mount is coaxially aligned with the respective first support leg to permit flexure of each support leg in the grasping and securement of the roof surface 9. A second support leg 48 is rigidly mounted to and in diametrically aligned relationship with the central cylindrical plate 46 spaced an equal distance between a plurality of first support legs 47. Each support leg includes a bifurcated claw member 49 mounted at each forward terminal end thereof defining an acute angle of generally sixty degrees. A safety line 51 is mounted to the central plate 46 and to the rectangular framework of the frame member to provide a safety anchor in positioning the support member to the roof surface.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roof creeper kit apparatus comprising, in combination, a support member, the support member including a first deflecting frame rail spaced from parallel to and coextensive with a second deflecting frame rail, and each deflecting frame rail including a deflecting frame rail forward end, and each deflecting frame rail including a deflecting frame rail rear end, and each forward end including a "J" shaped forward hook plate, and each rear end including a "U" shaped hook plate, and a forward frame brace orthogonally mounted to an upper surface of each frame rail, and a rear frame brace orthogonally and integrally mounted adjacent the rear terminal end of each frame rail, and a support platform orthogonally mounted overlying the first and second frame rail, with the support platform including an elongate forward pivot rod, with the forward pivot rod including a right and left end portion, and each respective right and left end portion pivotally mounted to the respective first and second frame rail, and a "U" shaped adjusting rod mounted underlying a rear terminal end of the support platform, and the "U" shaped adjusting rod including a right and left downwardly depending "L" shaped leg, and a right and left adjusting bracket mounted to the respective first and second frame rail underlying each "L" shaped leg to permit selective reception of each "L" shaped leg within each respective adjusting bracket to adjustably position the support platform relative to the respective first and second frame rail and wherein each "J" shaped hook plate includes an elongate body and a single forward hook, with the single forward hook underlying the elongate body defining an acute angle therebetween, and each rear hook plate including a rear elongate body and a single rear hook integrally mounted underlying a forward portion of the rear elongate body, with the single hook defining the acute angle between the single hook and the rear elongate body, and the rear hook plate further including a bifurcated rear hook, with the bifurcated rear hook defining an obtuse included angle between the rear elongate body and the rear bifurcated hook.

2. An apparatus as set forth in claim 1 wherein each interior surface of the forward single hook of the forward hook plate defines a beveled surface between the forward single hook and the elongate body of the forward hook plate.

3. An apparatus as set forth in claim 2 wherein the rear single hook and the rear bifurcated hook of the rear hook plate includes confronting surfaces underlying the rear elongate body, and wherein the confronting surfaces are beveled to enhance grasping and associated roof surface.

4. An apparatus as set forth in claim 3 further including an anchor member, the anchor member including a central cylindrical plate, the central cylindrical plate including three first support legs spaced radially an equal distance about the central plate, with each first support plate including an elongate spring mounting each first support leg to the central plate.

5. An apparatus as set forth in claim 4 including a single second support leg, wherein the single second support leg is positioned medially between a plurality of the first support legs, wherein the second support leg is rigidly and radially mounted to the central plate.

6. An apparatus as set forth in claim 5 wherein each of the first support legs includes a bifurcated claw member mounted at a remote end of each support leg spaced from the central plate, and wherein each claw member includes an elongate claw body and a bifurcated claw member underlying the elongate body, wherein the claw member defines an acute angle between the claw member and the body.

7. An apparatus as set forth in claim 6 further including a safety line, with the safety line mounted at a forward end to the central cylindrical plate and the safety line mounted at a rear end to the support member.

8. An apparatus as set forth in claim 5 wherein the apparatus further includes a plurality of ladder support brackets for mounting to a lower terminal end of a ladder leg, wherein each support bracket defines a "U" shaped claw member, wherein the "U" shaped claw member includes an elongate claw member body, with a forward single projection underlying the claw member body defining an acute angle therebetween, and the claw member body including a bifurcated rear claw portion defining an obtuse angle between the claw member body and the rear claw portion, and the claw member body including a plurality of spaced flanges integrally and orthogonally mounted to the claw member body, with the spaced flanges each including an aperture, wherein each aperture is aligned relative to one another, and a support pin receivable through the apertures for securement of a ladder leg thereto.

9. An apparatus as set forth in claim 8 wherein each right and left adjusting bracket includes an elongate series of apertures directed therethrough to receive a respecting "L" shaped leg of the "U" shaped adjusting rod therethrough.

10. An apparatus as set forth in claim 9 wherein the forward frame brace includes a right and left end portion overlying the first and second respective frame rail, and right and left elongate support brackets underlying the right and left end portions, wherein each elongate support bracket is fixedly mounted to each respective first and second frame rail, and each support bracket includes a first flange overlying an exterior side wall of each frame rail, and a second flange coextensively and orthogonally mounted to the support bracket positioned against an exterior surface of the forward frame brace.

* * * * *